US010675735B2

(12) United States Patent
Hall

(10) Patent No.: US 10,675,735 B2
(45) Date of Patent: Jun. 9, 2020

(54) HANDHELD SHARPENING APPARATUS

(71) Applicant: Simon Antony Hall, Taupo (NZ)

(72) Inventor: Simon Antony Hall, Taupo (NZ)

( * ) Notice: Subject to any disclaimer, the term of this patent is extended or adjusted under 35 U.S.C. 154(b) by 0 days.

(21) Appl. No.: 16/546,218

(22) Filed: Aug. 20, 2019

(65) Prior Publication Data

US 2020/0094379 A1 Mar. 26, 2020

(30) Foreign Application Priority Data

Sep. 21, 2018 (NZ) ..... 746559

(51) Int. Cl.
*B24D 15/02* (2006.01)
*B24D 15/06* (2006.01)
*B24D 15/08* (2006.01)

(52) U.S. Cl.
CPC ..... *B24D 15/023* (2013.01); *B24D 15/06* (2013.01)

(58) Field of Classification Search
CPC ..... B24D 15/023; B24D 15/06
See application file for complete search history.

(56) References Cited

U.S. PATENT DOCUMENTS 1,181,123 A * 5/1916 Edenborough ..... B24D 15/023 451/515
2,425,369 A * 8/1947 Fleming ..... B24D 15/026 451/493
2,763,968 A * 9/1956 Burns ..... B24D 15/023 451/524
4,361,990 A * 12/1982 Link ..... B24D 15/023 451/524
4,525,959 A * 7/1985 Ziebarth ..... B24D 15/023 451/504
2011/0177761 A1* 7/2011 Mastro ..... B24D 15/023 451/59
2015/0258662 A1* 9/2015 Ditto ..... B24D 15/023 451/524

FOREIGN PATENT DOCUMENTS

NZ 746559 1/2020

* cited by examiner

*Primary Examiner* — Daniel J Colilla

(57) ABSTRACT

A portable planar abrading or honing apparatus embodying components including modified elongated planar support block with flared ends each with holding arrangements and attached to the blocks planar surface are optional material support bases that assist various tensioned flexible abrasive material, described as abrasive tapes that facilitate manual grinding or honing and sharpening of edges upon the abrasive surface.

19 Claims, 3 Drawing Sheets

HANDHELD SHARPENING APPARATUS

TECHNICAL FIELD

Figure 1:
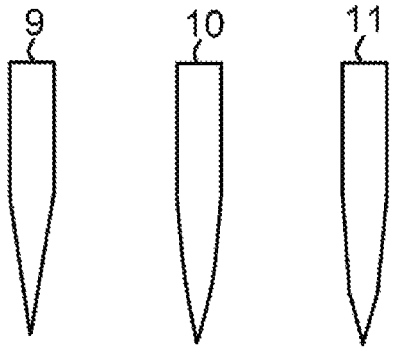

Hand tools or other devices for non-rotary grinding, polishing, or stropping specially designed for sharpening cutting edges of knives of razors and other implements with sharpening elements in interengaging or in mutual contact.

BACKGROUND OF HANDHELD SHARPENING APPARATUS

The project evolved from the inventor using honing stones and other tools such as files to sharpen edges of various implements toward lightening the load and fewer sharpening tools in remote places and wanting to also produce the useful convex edge using a single simple, light and compact apparatus.

This evolved planar sharpening apparatus directly relates to portable, simple and compact sized objectives and the need to be capable of multiple sharpening tasks, such as axe, machete, knife, razor and others.

Essentially light compact size and flat for comfortable pocket carry and versatile for users in a range of environments from home and workplace to remote places where simple to use and maintain are beneficial features to combine the functions of a file, honing stone, leather strop and convex edge sharpener into one sharpening apparatus.

Solution was to adapt sandpaper for use as it is lightest of all sharpening surfaces so it should be used.

Prior art It is known that emeries, sandpapers, linishing belts and other abrasive agents supported on flexible backing material that can optionally be waterproof are commonly used for sharpening by laying them on a flat surface that can be optionally resilient or non-resilient.

For simplification these abrasives on flexible backing material variations are generally referred to in the present document descriptions and claims as simply abrasive tape.

The advantages of the abrasive tape for this sharpening apparatus are light weight, compact sized and available in different types with various optional grits for specific or general sharpening purposes and easily portable and extra replacements are readily available with the user.

The sharpening apparatus simply holds the abrasive tape on top its planar surface.

Abrasive tapes are easily exchangeable by replacing finally worn out abrasive tapes for new so sharpening can resume. Replacements can be sourced on shop shelves and best available in the form of abrasive rolls or belts, sheets can be cut to fit.

The sharpening apparatus optionally sharpens straight or convex edges (see FIG. 1) and variations of these while held on a bench or hand held.

The sharpening apparatus is made for work in remote places but not excluding its usefulness inside the workshop and is also practical for food preparation and household use.

SUMMARY OF SHARPENING APPARATUS

A hand held compact size sharpening apparatus with two planar surfaces that optionally provides several available honing surfaces for the variety of honing or grinding options on the surface.

The sharpening apparatus construction comprises a compact light weight portable sized one part supporting block that is engineered for fitting parts onto support block planar surfaces for sharpening edges.

The support block's both sides have attached onto them optional materials to support the abrasive tape.

At one end of the support block are slots and bars for abrasive tape end retention and on the opposite end the abrasive tape is held by an elastic ring that is easy to clean and easy to exchange abrasive tapes.

The sharpening apparatus is able to hold various flexible abrasive tape types for metal or wood or plastics and others abrading.

The combination of all parts successfully makes the sharpening apparatus light to carry and comfortable fitting in a pocket so that it is readily available for users sharpening the range of edges it was made for.

The sharpening apparatus can produce various types of edges based on common straight, double bevel and convex edges and variations of the edges (see FIG. 1 for common edge shape references).

A convex edge in particular has advantages and is popular due to its shape having extra width behind the edge to strengthen and support and prevent the edge from rolling over or chipping from wear and tear. This edge has proven to be an advantageous type that this sharpening apparatus can produce. A convex edge is simpler than a double edged bevel to create as the convex is without the need for adjusting sharpening for a second angle and the edge the sharpening apparatus produces is less prone to rollover or chipping than the straight edges when honed at a lower angle for equivalent sharpness.

The sharpening apparatus is not limited to sharpening these examples; tools, axes, spades, scythes, machetes, knives and razors.

DESCRIPTIONS OF DRAWINGS

FIG. 1 drawing shows sharpened profiles produced.

Figure 2A:
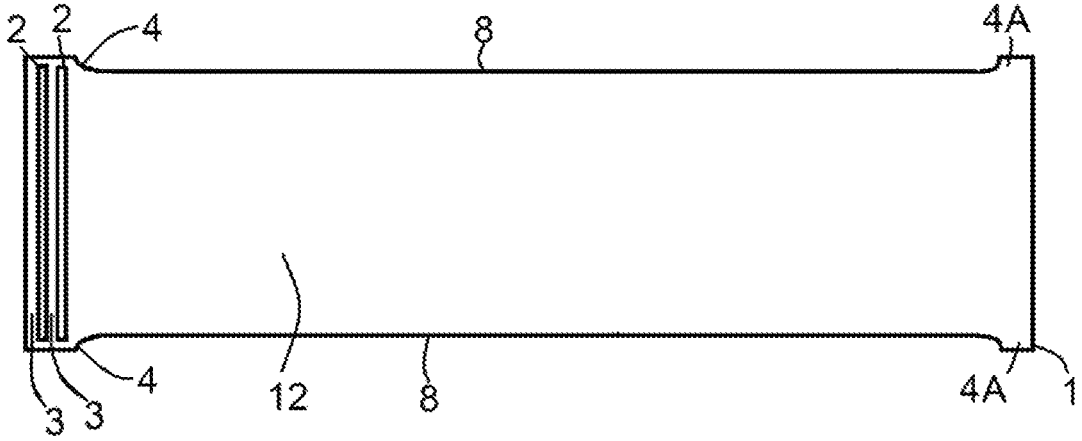
Figure 2B:
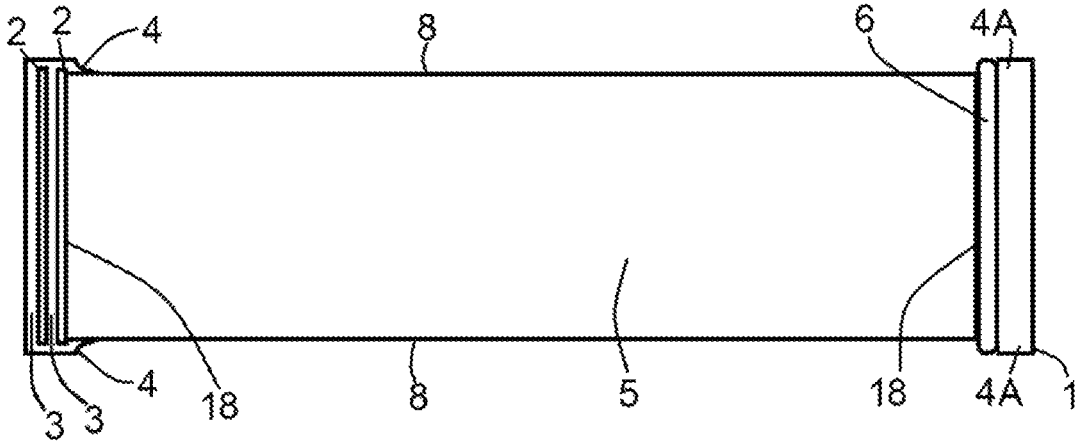

FIGS. 2*a* and 2*b* drawing of the portable hand held or bench operating edge sharpening apparatus planar view.

Figure 3:
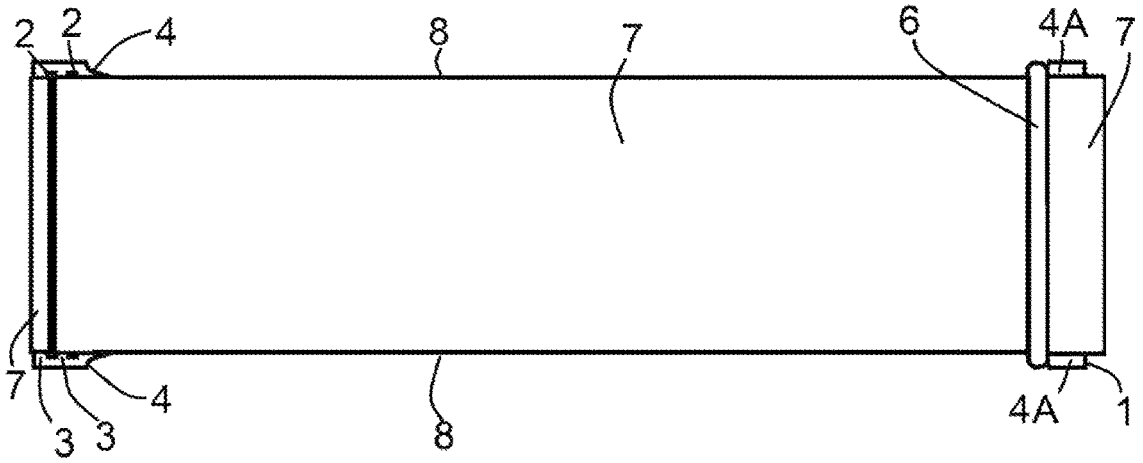

FIG. 3 drawing of the portable hand held or bench operating edge sharpening apparatus planar view.

Figure 4A:
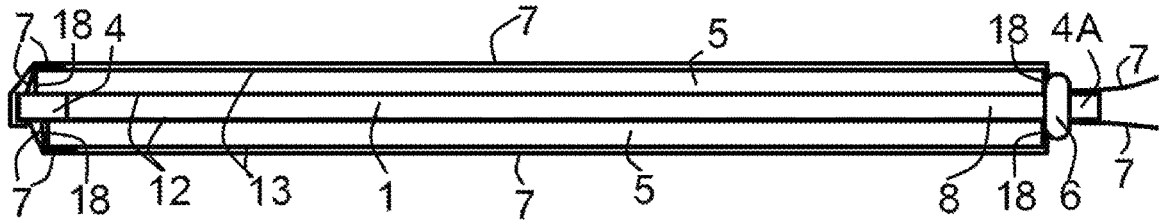
Figure 4B:
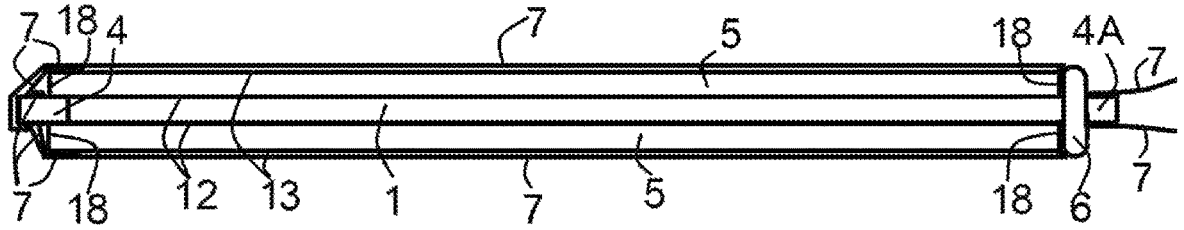

FIGS. 4*a* and 4*b* drawing of the portable hand held or bench operating edge sharpening apparatus sharpening apparatus side view.

Figure 5:
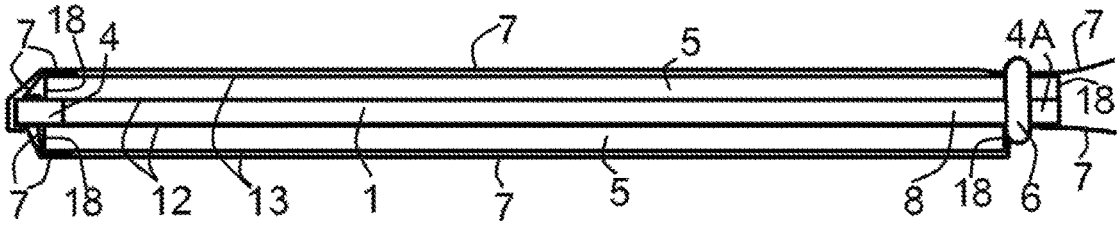

FIG. 5 drawing of the portable hand held or bench operating edge sharpening apparatus sharpening apparatus side view.

Figure 6:
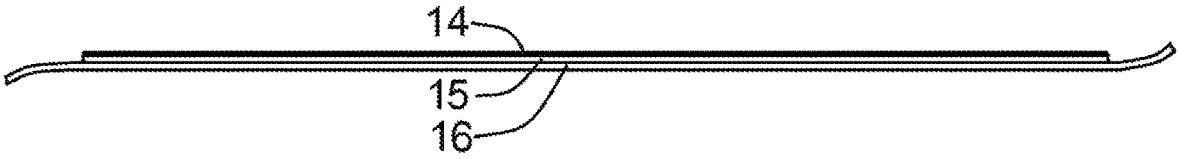

FIG. 6 drawing of the flexible abrasive tape is attached onto a flexible tape side view.

Figure 7:
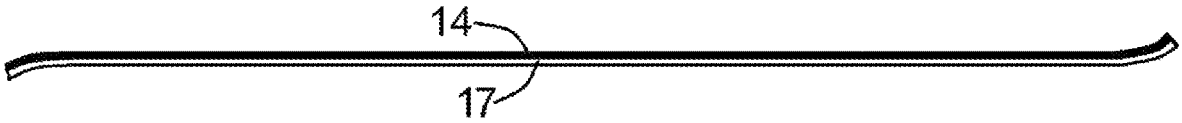

FIG. 7 drawing of the flexible abrasive tape side view.

IDENTIFICATION LIST FOR DRAWINGS WITH NEW AND AMENDED ELEMENTS UNDERLINED

1 Support block.
2 Slot for flexible abrasive tape to fit through.
3 Bar to fit flexible abrasive tape around.
4 First flared end.
4*a* Second flared end.
5 Abrasive tape support base.
6 Elastic ring.
7 Flexible abrasive tape.
8 Reduced waist size.
9 Straight edge.
10 Convex edge.
11 Double beveled edge.
12 Planar.
13 Planar surface.

14 Abrasive surface.
15 Inflexible abrasive tape.
16 More flexible tape.
17 Flexible backing material.
18 Abrasive tape support base end face.

DETAILED DESCRIPTION OF HANDHELD GRINDING, HONING OR STROPPING APPARATUS

A support block 1 that is elongated and generally rectangular having two of a planar 12 that are opposing each other and wider width at a first flared end 4 having two of a slot 2 and two of a bar 3 and a wider width at a second flared end 11 to retain an elastic ring 6 that is a flexible abrasive tape 7 tensioner in place. Disposed between the first flared end 4 and the second flared end 11 is a reduce waist. (See FIGS. 2*a* and 2*b*.)

The elastic ring 6 is fitted tightly onto the reduced waist size 8 at the second flared 4A end. The elastic ring 6 holds down one or two of the abrasive tapes 7 for tensioning. The elastic ring 6 can be pulled off the second flared end 4A by fingers to exchange or replace worn abrasive tapes 7. The elastic ring 6 is of a correct size to fit over the support blocks second flared end 4A and is limited from movement by the second flared end 4A of the support block 1. It is contemplated that the elastic ring has material attached. (See FIGS. 2*b*, 3, 4*a*, 4*b* and 5.)

The support block 1 has the reduced waist size 8 between the first flared end 4 and the second flared end 11 and on each of the support block's 1 two of the planar 12 the abrasive tape support bases 5 of resilient or non-resilient material are attached to. (See FIGS. 2*b*, 4*a*, 4*b* and 5.)

The Abrasive tape support bases 5 are generally rectangular in shape and substantially consistent thickness throughout in any of a continuous range of suitable thickness depth to raise the sharpening planar level above the elastic ring 6 height so the elastic ring 6 is preferably not exposed to accidental cutting. The height of the abrasive tape support bases 5 also blocks the elastic ring 6 from moving forward and this retains the tension for the abrasive tape 7 so grinding, polishing, or stropping can be performed. (See FIGS. 3, 4*a* and 4*b*.)

Optionally the abrasive tape support base end face 18 parallels the second flared end 4A of the support block 1. This is for an inflexible abrasive tape 15 fitted onto the planar surface 13 of the abrasive tape support base 5. (See FIG. 6.)

At the support block's 1 the first flared end 4 disposed at approximately 90 degrees laterally relative to the support block's 1 longest axis are two of the slots 2 that are elongated and created all the way through the support block creating the two bars 3. The two slots 2 and the two bars 3 are made for fitting through and wrapping around by fingers optionally none or one or two of the flexible abrasive tapes 7. Each one of the abrasive tapes 7 ends is passed through the slot 2 and the end is disposed over the planar surface 13 and adjacently the abrasive tape support base end face 18, then the flexible abrasive tape 7 is wrapped over the adjacent bar 3 away from the abrasive tape support base and passed through the elastic ring so that the flexible abrasive tape 7 is held by pressure and friction when the flexible abrasive tape 7 is tensioned. (See FIGS. 3, 4*a*, 4*b* and 5.)

Each one of the flexible abrasive tapes 7 ends are held firmly by friction resistance at the support block's 1 the first flared end's 4 the slots 2 and the bars 3 and tension is adjustable by manually pulling the extra flexible abrasive tape 7 end through the retaining elastic ring 6 tensioner disposed at the support block's 1 the second flared end 4A. The elastic ring 6 tension creates the pressure and resistance responsible for retaining each one of the flexible abrasive tapes 7. The elastic ring 6 can also be rolled forward over each one of the flexible abrasive tapes 7 to make more of each one of the flexible abrasive tapes 7 ends available for the fingers to grip if required to remove more slack and then rolled back to the elastic ring 6 retaining place between the second flared end 4 and the abrasive tape support bases end faces 18. (See FIGS. 2*b* 4*a*, 4*b* and 5.)

The flexible abrasive tapes 7 surfaces normally do not contact the support block 1 to cause abrasion to it by the way they are folded over and the abrasive tape support bases 5 prevent the abrasive tape's 7 an abrasive surface 14 contacting and also increase friction tension to hold the flexible abrasives tapes 7. (See FIGS. 4*a*, 4*b*, 5 and 7)

The flexible abrasive tape's 7 the abrasive surfaces 14 clogged with swarf or metal buildup can be cleaned for longer reuse by rubbing surface with rubber or by washing.

The support block's 1 the second flared end 11 where the elastic ring 6 is held can be used as trimming guide edge for the flexible abrasive tape 7 to be cut to a length that leaves spare length on the flexible abrasive tape 7 free to grip to pull tight for tensioning by fingers.

The removable tensioning the elastic ring 6 can optionally be abrasion resistant, hygienic food grade and replaceable after it reaches its useful life expiry date. Diameter of the elastic ring 6 is thick to assist rolling and stay in elastic shape.

A skilled user can optionally grind, polish, or strop materials by holding the sharpening apparatus's end by the thumb and middle finger and index finger supports the middle or first third of the back of the sharpening apparatus for stability and moving either the sharpening apparatus's the apparatus abrasive surface 14 on the implement's edge or move the implement's edge on the apparatus's the abrasive surface 14 to sharpen.

Sharpening apparatus's length allows for one half or two thirds to be used for sharpening safely while held by hand. The other end can be held in reverse and used in the same manner for full use of the length of the surface. By not creating an extra handle it keeps the apparatus to a compact size. It is contemplated that a handle could be extended or attached.

Alternatively the sharpening apparatus can be placed on a bench for stability and held by one flared end between thumb and index finger for extra grip and then swapping to the other end and repeating the honing action.

The sharpening apparatus produces any combinations of the following options listed;

- Optional leather support base 5 for razor edges where the blade to be sharpened is stropped in one direction. Honing compounds can optionally be applied onto the leather surface for faster edge honing using a one directional stropping motion and not pushing the edge into the leather.
- Leather surface can also support the flexible abrasive tape 7 option over the top of its surface for coarse grinding through to fine razor edge.
- Optional foods grade or non-foods grade non-resilient abrasive support base 5 in conjunction with the flexible abrasive tape 7 for grinding or a straight edge 9 or a double beveled edge 11 honing using said safe stropping motion or careful bidirectional motion where the edge is moved both directions on the abrasive surface 14.

Optional foods grade or non-foods grade non resilient or resilient the flexible abrasive tape support base 5 can also be used as a strop for finer edges with honing compounds applied to the surface.

Optional foods grade or non-foods grade resilient tape support base 5 flexibility shaped for producing a convex edge 9 or shape using safe stropping motion or carefully bidirectionally where the edge is moved both directions on the abrasive surface.

The handheld or bench operating abrading apparatus produces shapes in the general form of; the convex edge 10, a double beveled edge 11, a straight edge 9 (see FIG. 1) and also others and also non-rotary grinding, polishing, or stropping materials.

An abrasive surface 14 selected from a plurality of abrasive materials connected to a flexible backing material 17 selected from a plurality of the flexible backing materials 17, combined are generally referred as the flexible abrasive tape 7. (See FIG. 7.)

The combined thickness of the support block 1 and the flexible abrasive tapes 7 and the abrasive tape support bases 5 have a comfortable side surface thickness for finger grip.

The inflexible abrasive tape 15 can be adhered onto a flexible tape 16 to be attached to both ends of the support block 1.

What I claim is:

1. A portable hand held or bench operating abrading apparatus comprising:

a support block that is elongated and generally rectangular, with two opposed planar surfaces and a first flared end and a second flared end;

a reduced waist size between the first flared end and the second flared end;

said first flared end of the support block including two bars and two slots which are approximately parallel to one another, wherein the two bars and the two slots are for optionally retaining none or one or two of a flexible abrasive tape generally having a width the same or slightly less than the reduced waist size of the support block, wherein said two slots are perpendicular to a longitudinal axis of the support block, are elongated, and are formed all the way through the support block, wherein the bars are disposed alternately with the slots, wherein the bars and slots are configured for wrapping one or two of the flexible abrasive tapes around any one of the bars, wherein an end of one of the flexible abrasive tapes can be passed through the adjacent slot closest to the reduced waist size of the support block, and an opposite end of the one of the flexible abrasive tapes is disposed at the second flared end of the support block;

the an elastic ring, preferably abrasion resistant, wherein the elastic ring is held in place by the second flared end of the support block and is tightly fitted onto the reduced waist size, wherein the one or two abrasive tapes are passed though the elastic ring thereby holding the one or two abrasive tapes to the support block; and first and second abrasive tape support bases, wherein the first and second abrasive tape support bases are made of resilient or non-resilient material and are respectively attached to one of the opposed planar surfaces between the first flared and the second flared end.

2. The portable hand held or bench operating abrading apparatus according to claim 1 wherein the elastic ring is dexterously fitted over the second flared end of the support block onto the reduced waist size of the support block, thereby retaining the elastic ring in place.

3. The portable hand held or bench operating abrading apparatus according to claim 1 wherein the elastic ring is tensioned so that it fits tightly over the flexible abrasive tape or tapes, creating surface friction to maintain the flexible abrasive tape in tension so that the flexible abrasive tape is not loose while manually grinding, polishing or stropping.

4. The portable hand held or bench operating abrading apparatus according to claim 1 wherein the elastic ring is tensioned by fingers pulling extra length of each loose end of the one or two of the flexible abrasive tapes through the elastic rig, and the elastic ring is rolled forward over a top of each of the flexible abrasive tapes to make more of each of the flexible abrasive tapes ends available for tensioning if required.

5. The portable hand held or bench operating abrading apparatus according to claim 1 wherein the flexible abrasive tape comprises an abrasive surface selected from a plurality of abrasive materials connected to a flexible backing material selected from a plurality of the flexible backing materials, the abrasive surface and the abrasive backing material, when combined, are generally referred as the flexible abrasive tape or the flexible abrasive tapes and wherein each of the flexible abrasive tapes has two ends at which they are held on the support block for manual grinding, polishing or stropping upon the abrasive surface.

6. The portable hand held or bench operated abrading apparatus according to claim 1 wherein an inflexible abrasive tape is attached onto a flexible tape to attach to the first and second flared ends of the support block and held for use by the elastic ring.

7. The portable hand held or bench operating abrading apparatus according to claim 1 wherein a material layer configured as an abrasive tape support base is attached to each of the opposed planar surfaces of the support block and configured for supporting a suitable flexible abrasive tape so that manual grinding, polishing or stropping can be performed upon an abrasive surface of each flexible abrasive tape.

8. The portable hand held or bench operating abrading apparatus according to claim 7 wherein, on each of the opposed planar surfaces, a first end face of a respective one of the abrasive tape support bases is disposed at the second flared end of the support block and a second end face of the respective one of the abrasive tape support bases is disposed at a slot at the first flared end of the support block and sides of the respective one of the abrasive tape support base are fitted adjacently to the width of a middle planar portion of the reduced waist size of the support block for the purpose of supporting the one or two flexible abrasive tapes.

9. The portable hand held or bench operated abrading apparatus according to claim 7 wherein each of the abrasive tape support bases have a height such that an outer planar surface of each abrasive tape support base is higher than an outer diameter of the elastic ring during use of the portable hand held or bench operated abrading apparatus, thereby protecting the elastic ring from cuts.

10. The portable hand held or bench operating abrading apparatus according to claim 7 wherein an end face of each of the abrasive tape support bases is disposed nearer to the first flared end of the support block in order to attach a relatively inflexible flexible abrasive tape.

11. The portable hand held or bench operating abrading apparatus according to claim 7 wherein each of the flexible abrasive tape support bases are generally rectangular in shape and have a substantially consistent thickness throughout and preferably have a planar surface.

12. The portable hand held or bench operating abrading apparatus according to claim 7 wherein the combined thickness of the support block and the flexible abrasive tapes and the abrasive tape support bases have a comfortable side surface thickness for finger grip.

13. The portable hand held or bench operating abrading apparatus according to claim 7 wherein an end face of each of the abrasive tape support bases limits the elastic ring movement and assists the retention of the flexible abrasive tapes by tension and friction.

14. The portable hand held or bench operating abrading apparatus according to claim 7 wherein the abrasive tape support bases are formed from any one of: leathers, foods grade and non-foods grade resilient materials, foods grade and non-foods grade non-resilient materials.

15. The portable hand held or bench operating abrading apparatus according to claim 7 wherein the abrasive tape support bases are resilient and have flexibility allowing the abrasive tape support basses to conform to an edge of an implement being sharpened thereby increasing abrasion during sharpening.

16. The portable hand held or bench operating abrading apparatus according to claim 7 wherein each abrasive tape support base is resilient; and during a grinding, polishing, or stropping process, an edge of an implement is placed in contact with any one of said abrasive tape support bases or honing compound supported by any one of said abrasive tape support bases whereby each abrasive tape support base is capable of producing a convexly shaped edge in the implement.

17. The portable hand held or bench operating abrading apparatus according to claim 7 wherein the flexible abrasive tape support base is optionally a leather for razor edge sharpening and preferably stropping one directional action is used for sharpening.

18. The portable hand held or bench operating abrading apparatus according to claim 7 wherein an end face of each of the abrasive tape support bases is adjacent to one of said two slots and wherein an end of a flexible abrasive tape is fitted through said one of said two slots and disposed between a planar surface of a respective one of the abrasive tape support bases and the flexible abrasive tape that is fitted on top of the planar surface of the respective one of the abrasive tape support bases.

19. The portable hand held or bench operating abrading apparatus according to claim 1 wherein the apparatus is configured for non-rotary grinding, polishing, or stropping materials.

* * * * *